US005657002A

United States Patent [19]

Ogden

[11] Patent Number: 5,657,002

[45] Date of Patent: Aug. 12, 1997

[54] RESETTABLE LATCHING INDICATOR

[75] Inventor: Gerald W. Ogden, Elgin, Ill.

[73] Assignee: Electrodynamics, Inc., Rolling Meadows, Ill.

[21] Appl. No.: 579,182

[22] Filed: Dec. 27, 1995

[51] Int. Cl.[6] ..... G08B 21/00

[52] U.S. Cl. ..... 340/650; 340/638; 335/14; 335/17

[58] Field of Search ..... 340/650, 638; 335/6, 17, 18, 20, 175, 14; 361/8, 13

[56] References Cited

U.S. PATENT DOCUMENTS

| | | | |
|---|---|---|---|
| 2,855,483 | 10/1958 | Swing et al. | 337/244 |
| 3,225,170 | 12/1965 | Chabala et al. | 335/17 |
| 3,958,197 | 5/1976 | Gryctko | 335/18 |
| 4,186,365 | 1/1980 | Fahnoe | 337/206 |
| 4,263,589 | 4/1981 | Lewiner et al. | 340/638 |
| 4,336,520 | 6/1982 | Trayer | 337/191 |
| 4,442,471 | 4/1984 | Trayer | 361/63 |
| 4,473,860 | 9/1984 | Thomas | 335/6 |
| 4,516,182 | 5/1985 | Franklin | 335/16 |
| 4,598,263 | 7/1986 | Heyne et al. | 335/14 |
| 4,625,190 | 11/1986 | Wafer | 335/20 |
| 4,652,867 | 3/1987 | Mascot | 340/638 |
| 4,703,294 | 10/1987 | Yokoyama et al. | 335/6 |
| 4,906,963 | 3/1990 | Ackermann et al. | 337/244 |
| 4,975,673 | 12/1990 | Ikehata et al. | 335/17 |
| 4,987,395 | 1/1991 | Ozaki | 335/17 |
| 5,003,139 | 3/1991 | Edds et al. | 335/17 |
| 5,041,805 | 8/1991 | Ohishi et al. | 335/6 |
| 5,140,115 | 8/1992 | Morris | 335/17 |
| 5,153,565 | 10/1992 | Schweitzer, Jr. | 340/650 |
| 5,172,294 | 12/1992 | Ineichen et al. | 335/20 |
| 5,192,941 | 3/1993 | Fishovitz et al. | 340/638 |
| 5,260,679 | 11/1993 | Viscogliosi | 337/244 |
| 5,264,673 | 11/1993 | Powell | 335/17 |
| 5,319,344 | 6/1994 | Mosesian et al. | 337/244 |

*Primary Examiner*—Jeffery Hofsass
*Assistant Examiner*—Van T. Trieu
*Attorney, Agent, or Firm*—Pennie & Edmonds

[57] ABSTRACT

A resettable, latching indicator is described. The indicator has a pair of electrical terminals through which it connects to the circuitry whose state is being indicated. The device includes an electromagnetic coil with a first lead connected to a first terminal of the device and a second lead connected to a first contact within the device. A second contact within the device is connected to the second indicator terminal, completing the circuit within the device. In a preferred embodiment, the device is arranged as a fuse state indicator with the device terminals connected in parallel with a fuse. Before fuse blow, an internal electrical contact is formed as the first and second contacts are closed an abutment formed on a spring-biased indicator flag. When the fuse blows, current passes through the coil, thus creating a magnetic field. The field moves a spring-biased armature having a catch which normally retains the indicator flag in a non-indicating position. When the armature is moved, the catch releases the flag. The energy stored in the flag's spring is thereby released and the flag moves from a first, non-indicating position to a second, indicating position. Upon moving to the non-indicating position, the flag's abutment no longer keeps the contact members closed. This cuts off all current to the coil after fuse blow.

16 Claims, 4 Drawing Sheets

RESETTABLE LATCHING INDICATOR

BACKGROUND

The present invention relates generally to the field of indicator devices which, upon the occurrence of a predefined condition in an electric circuit, automatically display a visual indication that the condition has occurred. Circuit breakers, for example, display a colored flag if the electric current through a circuit exceeds a safe level. Similarly, fuse state indicators display a visual indication of whether a fuse has blown.

Some fuse state indicators ("FSIs") indicate fuse blow by turning on a light emitting diode ("LED") or other illuminating indicator. Others indicate fuse blow by changing the position of a mechanical indicator.

Fuse State Indicators having LED indicators require an electric current to illuminate the LED. Since this current is typically supplied by the fused circuit, such LED indicators require current to continue flowing through the fused circuit even after the fuse blows. If power to the circuit is removed to allow replacement of the blown fuse, the indicator turns off, eliminating any indication that the fuse has blown. Further, if an LED indicator is used with high voltage fuses, the LED itself must be protected, thereby increasing the complexity and cost of the FSI while adversely affecting its reliability.

FSIs having a mechanical indicator include a fusible wire which retains a plunger or other mechanical indicator in a non-indicating position. Upon fuse blow, current flows through the fusible wire causing it to heat up and melt. Upon melting, the wire releases a spring which pushes the mechanical indicator to an indicating position. Unlike LED indicators, such devices require no current to provide a visual indication and therefore maintain the indication if electric power is removed from the fused circuit. However, such devices are not reusable. Once the fusible wire melts, the indicator must be replaced with one having an intact fusible wire.

In general, the object of the invention is to provide an improved indicator device. More specifically, one object of the invention is to provide a non-volatile indicator device which, after an event has occurred, requires no electric power to maintain a visual indication that the event has occurred. Another object is to provide a mechanism for manually resetting the indicator to allow the indicator to be re-used. Still another object of the invention is to provide an improved fuse state indicator for detecting when a fuse blows and promptly providing a visual indication of the condition of the fuse without requiring any electric current to maintain that indication.

SUMMARY OF THE INVENTION

In general, the invention features a non-volatile indicator device for displaying an indication of whether a predefined condition has occurred in an electric circuit. The indicator includes a flag movable between a non-indicating position and an indicating position. Upon occurrence of the predefined condition, current from the electric circuit is routed to a magnetic field source such as a wire coil. For example, the magnetic field source may be connected in parallel with a variable impedance device whose impedance is normally relatively low but which dramatically increases upon occurrence of the predefined condition. When the impedance increases, current is routed to the magnetic source. In response to the current, the magnetic field source generates a magnetic field which causes the indicator to move to the indicating position, thereby providing a visual indication that the predefined condition has occurred. Once moved to the indicating position, the indicator is held in that position to assure that the indicator maintains the visual indication even if power is removed from the electric circuit and/or the indicator.

In preferred embodiments, the indicator includes an indicator spring for biasing the flag in the indicating position. To set the indicator to the non-indicating position, the flag is manually moved against the force of the spring. An armature then grips the indicator, holding it in the non-indicating position against the spring's biasing force. The armature is positioned sufficiently close to the magnetic field source that when the source generates the magnetic field, it imposes a force on the armature sufficient to release the indicator flag from the grip of the armature. The indicator spring then pushes the flag to the indicating position and holds it there. As the flag moves to the indicator position, the magnetic source is disconnected from the electric circuit, thereby interrupting the flow of current to the magnetic source and removing the magnetic field.

DESCRIPTION OF THE PREFERRED EMBODIMENT

Figure 1:
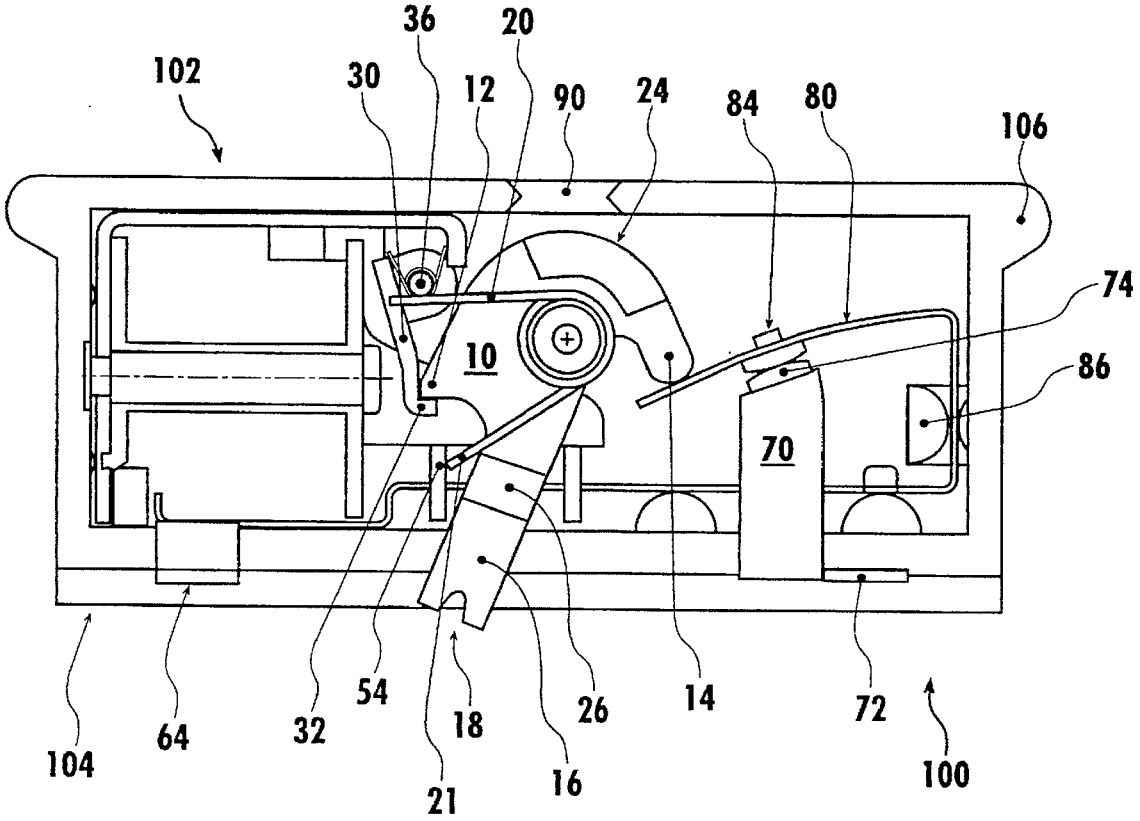
FIG. 1 is a top view of an indicator in accordance with the present invention in the non-indicating position.

Referring to FIG. 1, an indicator 100 includes a housing 106 having an upper surface 102 and a lower surface 104. Preferably, the housing is formed from a nonconductive material such as a hard plastic.

The upper surface 102 include a window 90 through which one may view a colored surface 24 formed on an indicator flag 10, as described further below. Although the window may just be an opening in the upper surface 102 of the housing, it is preferably formed from a transparent material such as a clear plastic or glass.

Figure 2:
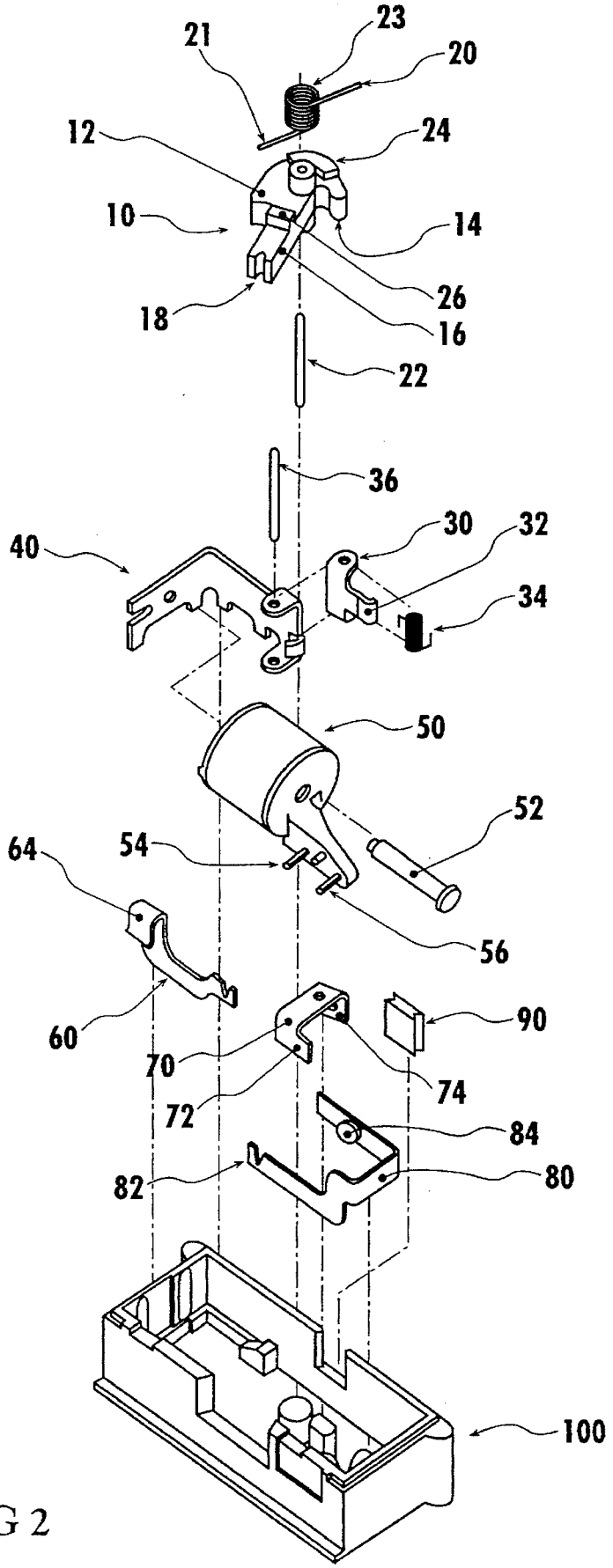
FIG. 2 is an exploded view of the indicator of FIG. 1.

A magnetic field coil 50 is mounted within housing 106. The coil includes a core 52 surrounded by a winding. The coil also has a pair of electrical inputs, 54 and 56. Referring to FIG. 2, first input 54 abuts a V-shaped notch 62 formed in connecting contact 60. Connecting contact 60 is clipped to the housing 106 such that a lip 64 of the connecting contact 60 is exposed on the outside of the housing's lower surface 104. The lip 64 serves as an indicator terminal, electrically connecting the first input 54 of the coil 50 to a terminal on a device whose state is to be indicated, such as a fuse. The second coil input 56 preferably abuts a second V-shaped notch 82 formed in the flexible contact assembly 80, described further below.

The purpose of the magnetic field source is to move the armature 30 when a current passes through the source. Any component capable of moving the armature will suffice for this purpose. For instance, an electrostrictive component connected to the armature will also suffice if it moves the armature upon the application of an electric current. Electrostatic means can also be used. Any source capable of generating a field sufficiently strong to move the armature may be used.

The performance specifications for the coil 50 depend on a number of factors known to those in the art, including the level of magnetic flux that must be generated to move the armature 32, the estimated coil voltage (and corresponding current) required to generate that level of magnetic flux, and the maximum flow of current which the coil is expected to carry. Preferably, the coil also has a built-in safety feature which interrupts the flow of current through the coil if the current becomes excessive. Specifically, the winding may fuse when the current flow is too great.

As best shown in FIG. 2, the coil 50 is attached to a pole piece 40 which nests in the housing 106. The armature 30 is rotatably mounted at a first end to the pole piece 40 by means of an armature shaft 36. The armature 30 rotates around the armature shaft 36 in a hinged manner proximate to the core 52 of the coil 50. Thus, the armature 30 is situated in an area under the influence of the magnetic field created by the coil 50. In the preferred embodiment, the armature 30 is biased away from the coil 50 and the core 52 by an armature spring 34 which is coaxially mounted around the armature shaft 36.

The second end of the armature is provided with a catch 32 arranged to engage a corresponding first portion 12 of the indicator flag 10, as best shown in FIG. 1. As best shown in FIG. 2, the flag 10 is rotatably mounted to the housing by a flag shaft 22. A flag spring 23 mounted on the flag 10 coaxially with the flag shaft 22 biases the flag in an indicating position. The biasing is achieved by a first flag spring leg 20 abutting the armature shaft and a second flag spring leg 21 abutting against a raised surface 26 of the flag 10.

The flag further includes an arm 16 which extends outside the housing and is provided with a notched end 18. From the indication position shown in FIG. 3, the flag 10 may be reset to the non-indicating position by manually moving the arm 16 and re-cocking the armature. The flag may also be reset by inserting a screw-driver or other object into the notched end 18 and flipping the arm back to the non-indicating position of FIG. 1.

As indicated above, the flag has a colored surface 24. Preferably, a first region of this surface 24, visible through the window 90 when the flag 10 is in the non-indicating position, is colored a first color and a second region of this surface 24, visible through the window 90 when the flag is in the indicating position, is colored a second color.

The flag 10 also includes a second portion, shown in the figures as an abutment 14. This second portion controls the opening and closing of an electrical connection between a first contact, shown as a contact button 84 mounted on a flexible contact assembly 80 and a second contact, shown as a second contact button 74 mounted on a stationary contact assembly 70.

In the preferred embodiment, the abutment 14 abuts the flexible contact assembly 80, causing the first contact button 84 to touch the second contact button 74. However, the two contacts may be arranged in a different manner and the second portion may perform a slightly different function without departing from the invention. For instance, both contacts may be mounted on a single non-conductive assembly and the second portion may be formed from a conductive material isolated from the rest of the flag. In such case, the conductive material connects the two contacts, thus completing the circuit. Regardless of the particular structure used, when the flag 10 is in the non-indicating position, the second portion 14 assists in completing an electrical connection between the two contacts and when the flag is in the indicating position, the contacts are no longer connected.

The flexible contact assembly 80 and the stationary contact assembly 70 are preferably formed from a conductive metal such as copper and are fixed to the housing by retaining members 86 or other equivalent means. The stationary contact assembly is clipped onto the edge of the housing 106 and arranged such that a lip 72 of the stationary contact assembly is exposed on the outside of the housing's lower surface 104, not unlike the connecting contact lip 64. Thus, the stationary contact assembly lip 72 serves as a second indicator terminal used to connect the device to other circuit elements.

Figure 4:
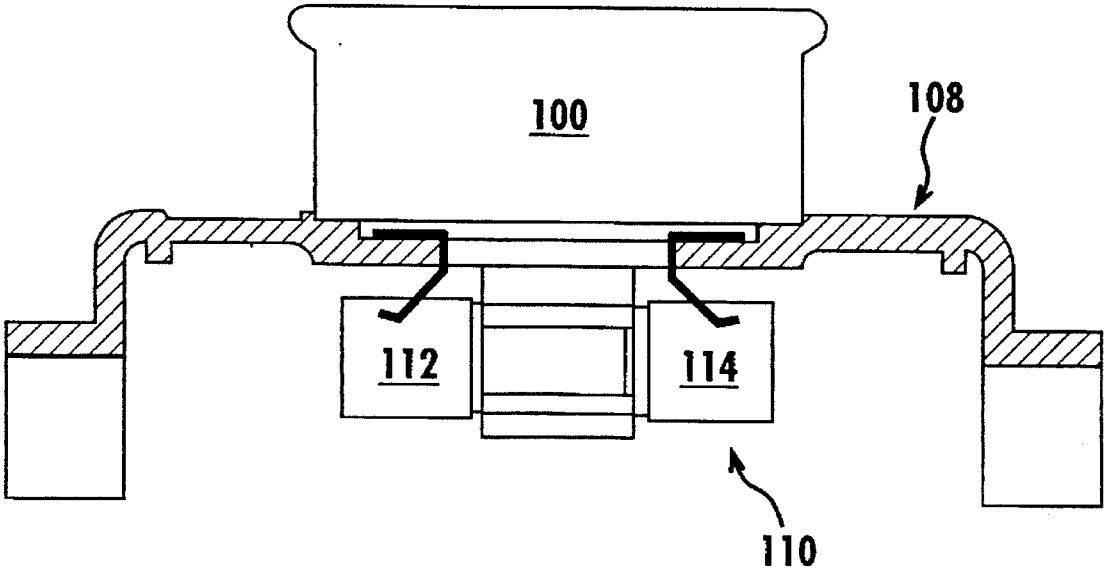
FIG. 4 is an illustration of a fuse state indicator attached to a fuse cover.

The operation of the indicator 100 configured to indicate the condition of a fuse is described below. As shown in FIG. 4, a fuse cover 108 covers fuse 110 and the indicator 100 is mounted on the fuse cover 108. The indicator 100 is connected in parallel with the fuse 110 whose state is being indicated. With the device configured as a fuse state indicator, one terminal 112 of the fuse 110 is connected to the connecting contact lip 64 and the other fuse terminal 114 is connected to the stationary contact lip 72. The flag is set to the non-indicating position shown in FIG. 1 with its first portion 12 being held by the armature catch 32. In this position, the flag abutment 14 maintains the contact buttons 74, 84 in contact with one another, thus completing the circuit within the indicator 100.

The fuse is a variable impedance device. When the fuse is intact, its impedance is essentially zero. When it blows, the fuse's impedance dramatically rises to an essentially infinite impedance. When the fuse's impedance increases, current is routed through the coil 50 connected in parallel with the fuse; creating a magnetic field. The armature 30 is then attracted towards the core 52, and the catch releases the first portion 12 of the flag 10. The coiled flag spring 23 releases its stored energy, causing the flag 10 to assume the indicating position shown in FIG. 3. In the indicating position, the contact buttons 74, 84 no longer touch one another as the abutment 14 no longer forces down the flexible contact assembly 80. Thus, the indicator is disconnected from the fused circuit, thereby preventing any current from flowing through the fused circuit. Despite the lack of current flow, the flag 10 remains in the indicating position, held by the flag spring.

Preferably, the coil includes a backup safety mechanism for interrupting current flow through the fused circuit in the event that the contact buttons 74, 84 for some reason fail to disconnect the winding from the fused circuit upon fuse blow. For example, as explained above, the winding may fuse when the current flow through the winding exceeds a safe level for too long a period of time.

As the flag 10 moves from the non-indicating to the indication position, a different region of the colored surface 24 of the flag becomes visible through the window, signifying that the fuse has blown.

Figure 3:
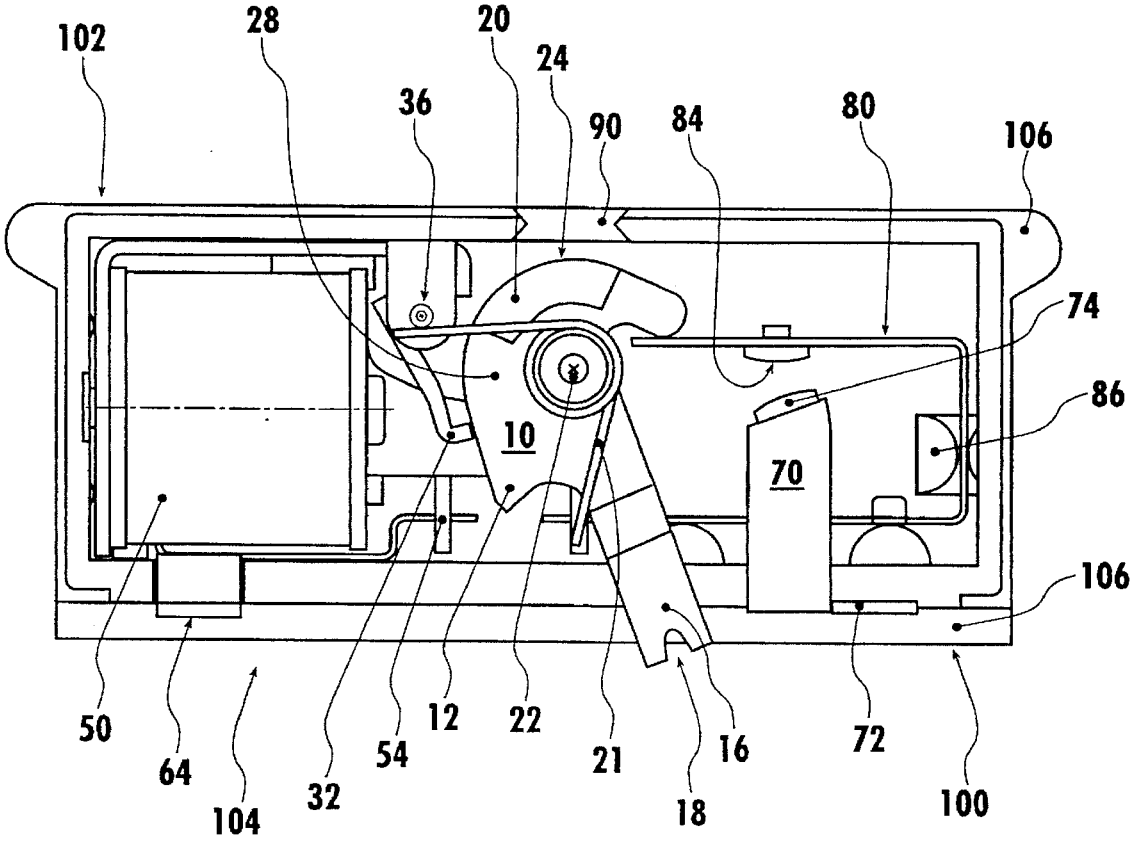
FIG. 3 is a top view of the indicator of FIG. 1 in the indicating position.

Once the indicator is electrically disconnected from the fused circuit, the coil no longer generates a magnetic field to attract the armature. Since the armature 30 is biased away from the coil 50, it abuts the outer perimeter 28 of the flag when the flag is in the indicating position, as shown in FIG. 3.

After fuse blow, the fuse cover 108 is removed and the fuse is replaced. The flag is then returned to the non-indicating position as described above, and the fuse cover 108 with the mounted indicator 100 is placed over the new fuse.

In the preferred embodiment for a fuse state indicator, the coil resistance is 75 ohms and is intended for use on AC power lines of 32 volts up to 600 volts. The coil requires approximately 26 volts at 0.35 amperes of current to move the armature. After a fuse blows, the voltage across the indicator rises toward the line voltage. When the coil current reaches approximately 0.35 amperes, the armature moves, releasing the flag and opening the current path within approximately three to four milliseconds.

By varying the strengths of the springs and the parameters of the coil, the indicator may be adjusted to trip upon sensing a wide range of currents and voltages. The operation, or pull-in, of the armature is determined by the amount of magnetic flux produced and the load on the armature which, in turn, depends on the bias spring strength and the flag frictional load on the armature catch 32. The amount of magnetic flux produced is a function of the ampere-turns on the coil. Thus, an indicator can be made to operate at any desired current by adjusting the coil wire size and number of turns.

While the invention has been described in conjunction with preferred embodiments, numerous alternatives, modifications, variations and uses will be apparent to those skilled in the art in light of the foregoing description which are within the following claims.

What is claimed is:

1. A resettable latching indicator comprising:

a housing;

first and second indicator terminals;

a magnetic field source mounted on said housing, said source having a first and a second electrical input, said first input electrically connected to said first indicator terminal;

an armature having a catch, said armature positioned in an area under the influence of said source and spring biased away from said source, said armature being attracted to the source when said source is energized;

an indicator flag having a first flag portion engageable with said catch and a second flag portion, said indicator flag movable between a normally non-indicating position and an indicating position;

a first electrical contact connected to said second input; and a second electrical contact connected to said second indicator terminal, said second flag portion arranged to electrically connect said first and second electrical contacts.

2. An indicator as claimed in claim 1 wherein the source is an electromagnetic coil, said coil comprising a winding and a core.

3. An indicator as claimed in claim 1 wherein the armature catch maintains the indicator flag in said normally non-indicating position.

4. An indicator as claimed in claim 1 wherein the armature abuts the indicator flag when said flag is in the non-indicating position.

5. An indicator as claimed in claim 1 wherein the indicator flag further comprises a third portion whereby said flag may be reset.

6. An indicator as claimed in claim 5 wherein said third portion is an arm having a notched end, said notched end being accessible from outside said housing.

7. An indicator as claimed in claim 1 further comprising a window fixed on the housing.

8. An indicator as claimed in claim 7 wherein said indicator flag is provided with a colored surface visible through said window, a color of said surface reflecting whether the flag is in the non-indicating or the indicating position.

9. An indicator as claimed in claim 1 wherein the indicator flag is spring-biased and rotatably mounted on said housing.

10. An indicator as claimed in claim 1 wherein said second portion comprises an abutment.

11. An indicator as claimed in claim 10 wherein said first electrical contact comprises a first contact button mounted on a flexible contact assembly and said second electrical contact comprises a second contact button mounted on a stationary contact assembly.

12. An indicator as claimed in claim 11 wherein said abutment abuts said flexible contact assembly, causing said first contact button to electrically connect with said second contact button when said flag is in the non-indicating position.

13. A resettable, latching fuse state indicator for a fuse having first and second fuse terminals, said fuse state indicator comprising:

a housing;

first and second indicator terminals;

a magnetic field source mounted on said housing, said source having a first and a second electrical input, said first input electrically connected to said first indicator terminal;

an armature having a catch, said armature positioned in an area under the influence of said source and spring biased away from said source, said armature being attracted to the source when said source is energized;

an indicator flag having a first flag portion engageable with said catch and a second flag portion, said indicator flag movable between a normally non-indicating position and an indicating position;

a first electrical contact connected to said second input; and a second electrical contact connected to said second indicator terminal, said second flag portion arranged to electrically connect said first and second electrical contacts, wherein said first indicator terminal is electrically connected to said first fuse terminal and said second indicator terminal is electrically connected to said second fuse terminal.

14. An indicator for providing a visual indication that a predefined condition has occurred in an electric circuit, comprising:

an indicator flag movable between a non-indicating position and an indicating position, a magnetic field source which, when supplied with an electric current, generates a magnetic field which causes said indicator to move from said non-indicating position to said indicating position, and a variable impedance device, connected in parallel with said magnetic field source, having at least a low impedance state and a high impedance state, wherein upon occurrence of said predefined condition, said variable impedance device changes from said low impedance state to said high impedance state, thereby routing electric current to said magnetic field source.

15. A device according to claim 14 wherein said variable impedance device is a fuse, said fuse having low impedance when not blown and high impedance when blown.

16. A resettable latching indicator comprising:

a housing;

first and second indicator terminals;

a magnetic field source mounted on said housing, said source having a first and a second electrical input, said first input electrically connected to said first indicator terminal;

an armature having a catch, said armature positioned in an area under the influence of said source;

an indicator flag movable between a normally non-indicating position and an indicating position, said indicator flag having a first flag portion integrally formed therewith and a second flag portion, said first flag portion adapted to be engaged with said catch;

a first electrical contact connected to said second input; and a second electrical contact connected to said second indicator terminal, said second flag portion arranged to electrically connect said first and second electrical contacts.

* * * * *